US010424270B2

(12) United States Patent
Tomabechi et al.

(10) Patent No.: US 10,424,270 B2
(45) Date of Patent: Sep. 24, 2019

(54) DISPLAY APPARATUS AND CONTROL METHOD THEREOF

(71) Applicant: CANON KABUSHIKI KAISHA, Tokyo (JP)

(72) Inventors: Masaru Tomabechi, Yokohama (JP); Mitsuru Tada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 15/924,911

(22) Filed: Mar. 19, 2018

(65) Prior Publication Data

US 2018/0277059 A1 Sep. 27, 2018

(30) Foreign Application Priority Data

Mar. 22, 2017 (JP) ..... 2017-055573

(51) Int. Cl.
*G09G 5/10* (2006.01)
*G09G 3/34* (2006.01)

(52) U.S. Cl.
CPC ..... *G09G 5/10* (2013.01); *G09G 3/3413* (2013.01); *G09G 3/3426* (2013.01); *G09G 2320/0242* (2013.01); *G09G 2320/0626* (2013.01); *G09G 2320/0633* (2013.01); *G09G 2320/0666* (2013.01); *G09G 2340/06* (2013.01); *G09G 2360/144* (2013.01); *G09G 2370/12* (2013.01)

(58) Field of Classification Search
None
See application file for complete search history.

(56) References Cited

U.S. PATENT DOCUMENTS

2015/0228232 A1* 8/2015 Lee ..... G09G 3/3607 345/88
2016/0349429 A1* 12/2016 Song ..... G02B 6/005
2018/0197444 A1* 7/2018 Mao ..... G09F 9/3026

FOREIGN PATENT DOCUMENTS

JP 2011-106875 A 6/2011

* cited by examiner

*Primary Examiner* — Nicholas J Lee
(74) *Attorney, Agent, or Firm* — Cowan, Liebowitz & Latman, P.C.

(57) ABSTRACT

In a display apparatus, a light-emitting unit emits light of a first color; a converting unit emits light of the first color, a second color, and a third color responding to irradiation of the light of the first color from the light-emitting unit; a detecting unit outputs a first detected value in accordance with brightness of the light of the first color, and a second detected value in accordance with brightness of the light of the second color; a correcting unit corrects components corresponding to the first color, the second color, and the third color of input image data, based on the first and second detected values, and a display unit displays an image on a screen by transmitting the light emitted from the converting unit, based on the corrected input image data.

20 Claims, 13 Drawing Sheets

FIG. 10

| Rbf | Rgf | Xf | Yf | Zf |
|---|---|---|---|---|
| 0 | 0 | 0 | 0 | 0 |
| 1 | 1 | 1 | 1 | 1 |
| ⋮ | ⋮ | ⋮ | ⋮ | ⋮ |
| 101 | 106 | 105 | 106 | 101 |
| ⋮ | ⋮ | ⋮ | ⋮ | ⋮ |
| 103 | 110 | 109 | 110 | 103 |
| ⋮ | ⋮ | ⋮ | ⋮ | ⋮ |
| 255 | 280 | 270 | 280 | 255 |

FIG. 11

| Rbi | Rgi | Xi | Yi | Zi |
|---|---|---|---|---|
| 101 | 106 | 105 | 106 | 101 |

DISPLAY APPARATUS AND CONTROL METHOD THEREOF

BACKGROUND OF THE INVENTION

Field of the Invention

The present invention relates to a display apparatus and a control method thereof.

Description of the Related Art

As a backlight unit of a liquid crystal display apparatus, a light-emitting unit including a blue light source, and a wavelength converting member which has a red phosphor and a green phosphor, has been proposed. The red phosphor is a phosphor which emits a red light due to excitation caused by the blue light. The green phosphor is a phosphor which emits a green light due to excitation caused by the blue light. In this light-emitting unit, a part of the blue light emitted from the blue light source is converted into the red light by the red phosphor, and this red light is emitted from the wavelength converting member. A part of the blue light emitted from the blue light source is also converted into the green light by the green phosphor, and this green light is emitted from the wavelength converting member. And a part of the blue light emitted from the blue light source is emitted from the wavelength converting member without being converted (transmitted). As a result, the light in a wide color gamut, including the blue light, the red light and the green light, can be emitted from the light-emitting unit.

In recent years, a quantum dot has been proposed as a wavelength converting element, which can generate highly pure light by causing excitation. The quantum dot reacts to ultraviolet light, blue light or the like, and emits light corresponding to the particle diameter of the quantum dot. If a quantum dot is used, light of which half width is about 40 nm (e.g. red light, green light) can be obtained from the blue light, hence light in a wider color gamut can be obtained as light emitted from the light-emitting unit.

A technique on the display apparatus is disclosed in Japanese Patent Application Publication No. 2011-106875. In the technique disclosed in Japanese Patent Application Publication No. 2011-106875, display is controlled based on the detected value by a sensor which detects the natural light directed to the display apparatus.

SUMMARY OF THE INVENTION

However the characteristic of the quantum dot changes over time because of heat, humidity and the like. The light emitted from the wavelength converting member having the quantum dot is changed by a change in the characteristic of the wavelength converting member (more specifically, the quantum dot). The light emitted from the wavelength converting member is also changed by a change in the emission brightness of the light source, which emits the excitation light (light which excites the quantum dot). By these changes of the light emitted from the wavelength converting member, the display color (color on screen) changes.

In the case of the technique disclosed in Japanese Patent Application Publication No. 2011-106875, only natural light is considered. This means that the above mentioned change of the display color cannot be reduced, even if the technique disclosed in Japanese Patent Application Publication No. 2011-106875 is used.

The present invention in its first aspect provides a display apparatus, comprising:

a light-emitting unit configured to emit light of a first color;

a converting unit configured to emit light of the first color, light of a second color, and light of a third color responding to irradiation of the light of the first color emitted from the light-emitting unit;

a detecting unit configured to output a first detected value in accordance with brightness of the light of the first color, and a second detected value in accordance with brightness of the light of the second color;

a correcting unit configured to correct a component corresponding to the first color, a component corresponding to the second color, and a component corresponding to the third color of input image data, based on the first detected value and the second detected value, and a display unit configured to display an image on a screen by transmitting the light emitted from the converting unit, based on the corrected input image data.

The present invention in its second aspect provides a display apparatus comprising:

a plurality of light sources configured to emit light of a first color;

a converting sheet that is positioned further toward a front face side than the plurality of light sources, and is configured to convert a part of the light of the first color emitted from at least one light source of the plurality of light sources into light of a second color and light of a third color, which are different from the first color;

a first sensor that is positioned further toward a rear face side than the converting sheet, and is configured to output a first detected value corresponding to brightness of the light of the first color emitted from at least one light source of the plurality of light sources;

a second sensor that is positioned further toward the rear face side than the converting sheet, and is configured to output a second detected value corresponding to brightness of the light of the second color converted by the converting sheet;

a correcting unit configured to correct image data, based on the first detected value and the second detected value; and a display panel that is positioned further toward the front face side than the converting sheet, and is configured to display an image by transmitting the light of the first color, the light of the second color, and the light of the third color, based on the corrected image data, wherein the correcting unit corrects the image data by using a detected value of brightness of light, the number of color components of which is less than the number of color components of the image data.

The present invention in its third aspect provides a control method of a display apparatus, comprising:

emitting, by a light-emitting unit, light of a first color;

converting, by a converting unit, emit light of the first color, light of a second color, and light of a third color responding to irradiation of the light of the first color emitted from the light-emitting unit;

outputting, by a detecting unit, a first detected value in accordance with brightness of the light of the first color, and a second detected value in accordance with brightness of the light of the second color;

correcting, by a correcting unit, a component corresponding to the first color, a component corresponding to the second color, and a component corresponding to the third color of input image data, based on the first detected value and the second detected value, and displaying, by a display unit, an image on a screen by transmitting the light emitted from the converting unit, based on the corrected input image data.

The present invention in its fourth aspect provides a control method of a display apparatus comprising:

emitting, by at least one light source of a plurality of light sources, light of a first color;

converting, by a converting sheet that is positioned further toward a front face side than the plurality of light sources, a part of the light of the first color emitted from at least one light source of the plurality of light sources into light of a second color and light of a third color, which are different from the first color;

outputting, by a first sensor that is positioned further toward a rear face side than the converting sheet, a first detected value corresponding to brightness of the light of the first color emitted from at least one light source of the plurality of light sources;

outputting, by a second sensor that is positioned further toward the rear face side than the converting sheet, a second detected value corresponding to brightness of the light of the second color converted by the converting sheet;

correcting, by a correcting unit, image data based on the first detected value and the second detected value; and displaying, by a display panel that is positioned further toward the front face side than the converting sheet, an image by transmitting the light of the first color, the light of the second color, and the light of the third color, based on the corrected image data, wherein the correcting unit corrects the image data by using a detected value of brightness of light, the number of color components of which is less than the number of color components of the image data.

The present invention in its fifth aspect provides a non-transitory computer readable medium that stores a program, wherein the program causes a computer to execute:

emitting, by a light-emitting unit, light of a first color;

converting, by a converting unit, emit light of the first color, light of a second color, and light of a third color responding to irradiation of the light of the first color emitted from the light-emitting unit;

outputting, by a detecting unit, a first detected value in accordance with brightness of the light of the first color, and a second detected value in accordance with brightness of the light of the second color;

correcting, by a correcting unit, a component corresponding to the first color, a component corresponding to the second color, and a component corresponding to the third color of input image data, based on the first detected value and the second detected value, and displaying, by a display unit, an image on a screen by transmitting the light emitted from the converting unit, based on the corrected input image data.

The present invention in its sixth aspect provides a non-transitory computer readable medium that stores a program, wherein the program causes a computer to execute:

emitting, by at least one light source of a plurality of light sources, light of a first color;

converting, by a converting sheet that is positioned further toward a front face side than the plurality of light sources, a part of the light of the first color emitted from at least one light source of the plurality of light sources into light of a second color and light of a third color, which are different from the first color;

outputting, by a first sensor that is positioned further toward a rear face side than the converting sheet, a first detected value corresponding to brightness of the light of the first color emitted from at least one light source of the plurality of light sources;

outputting, by a second sensor that is positioned further toward the rear face side than the converting sheet, a second detected value corresponding to brightness of the light of the second color converted by the converting sheet;

correcting, by a correcting unit, image data based on the first detected value and the second detected value; and displaying, by a display panel that is positioned further toward the front face side than the converting sheet, an image by transmitting the light of the first color, the light of the second color, and the light of the third color, based on the corrected image data, and the correcting unit corrects the image data by using a detected value of brightness of light, the number of color components of which is less than the number of color components of the image data.

Further features of the present invention will become apparent from the following description of exemplary embodiments with reference to the attached drawings.

BRIEF DESCRIPTION OF THE DRAWINGS

FIG. 10 is an example of first information according to Example 1;

FIG. 11 is an example of predetermined XYZ tristimulus values according to Example 1;

DESCRIPTION OF THE EMBODIMENTS

Example 1

Example 1 of the present invention will be described. In the following, an example of a display apparatus, which includes an image processing apparatus according to this example, will be described. The image processing apparatus may be an apparatus that is separated from the display apparatus. Examples of the image processing apparatus that are separated from the display apparatus are: a personal computer (PC), a playback system (e.g. Blue Ray player) and a server apparatus.

Figure 1:
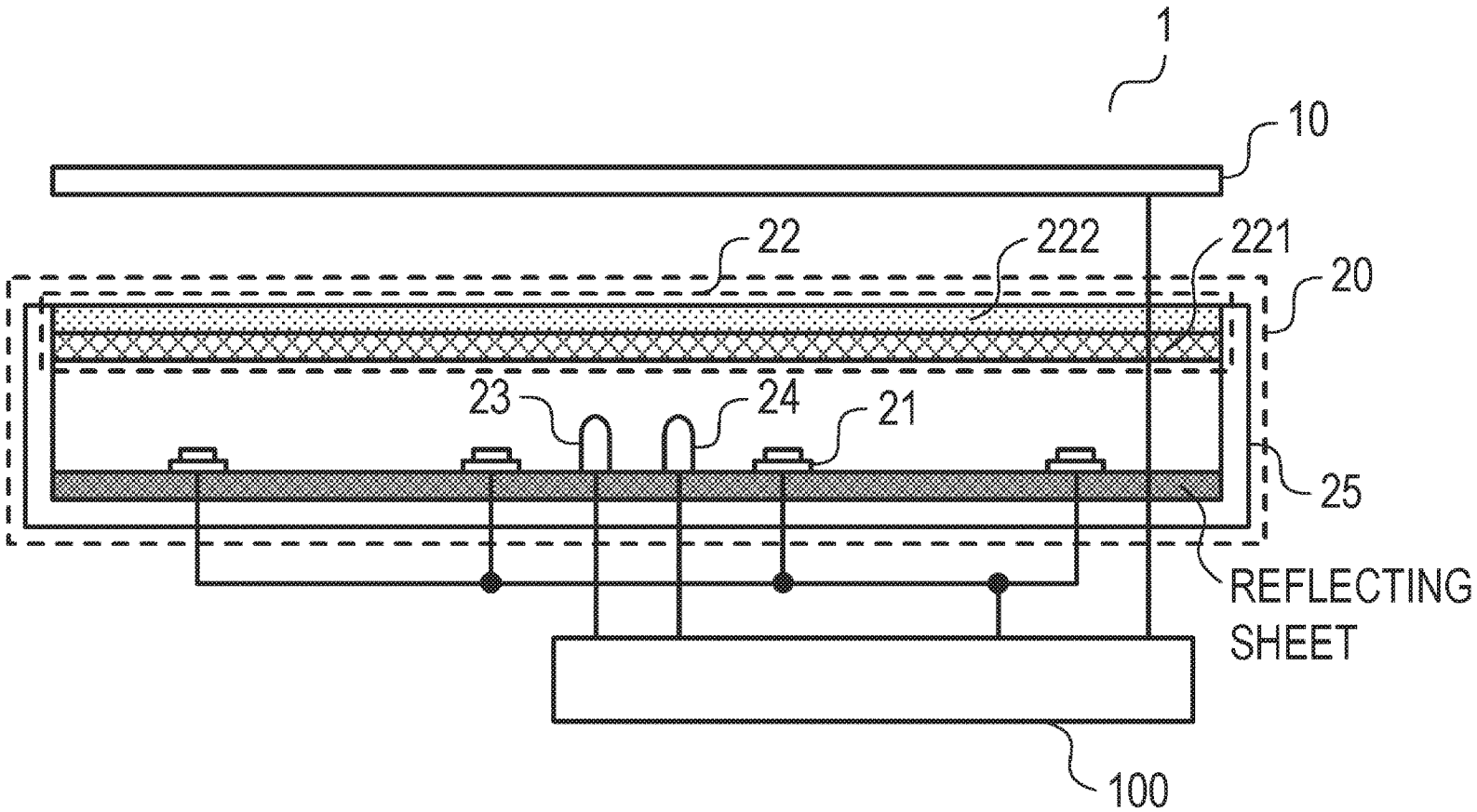
FIG. 1 is a configuration example of a display apparatus according to Example 1.

FIG. 1 is a diagram depicting a configuration example of a display apparatus 1 according to this example. FIG. 1 is a cross-sectional view (cross-section of the display apparatus 1) sectioned at a plane that is vertical to the screen of the display apparatus 1. The display apparatus 1 includes a display panel 10, a light-emitting unit 20, and a display control unit 100.

The display panel (display unit) 10 displays an image by transmitting the light emitted from the light-emitting unit 20. For example, a liquid crystal panel, a Micro Electro Mechanical System (MEMS) shutter type display panel or the like can be used as the display panel 10.

The light-emitting unit 20 irradiates light to the rear face of the display panel 10. The light-emitting unit 20 includes a light source unit 21, an optical sheet 22, a first brightness sensor 23, a second brightness sensor 24 and a housing 25. The light source unit 21, the optical sheet 22, the first brightness sensor 23 and the second brightness sensor 24 are fixed to the housing 25. If the display apparatus 1 is a liquid crystal display apparatus, the light-emitting unit 20 may be called a "backlight unit".

Figure 2:
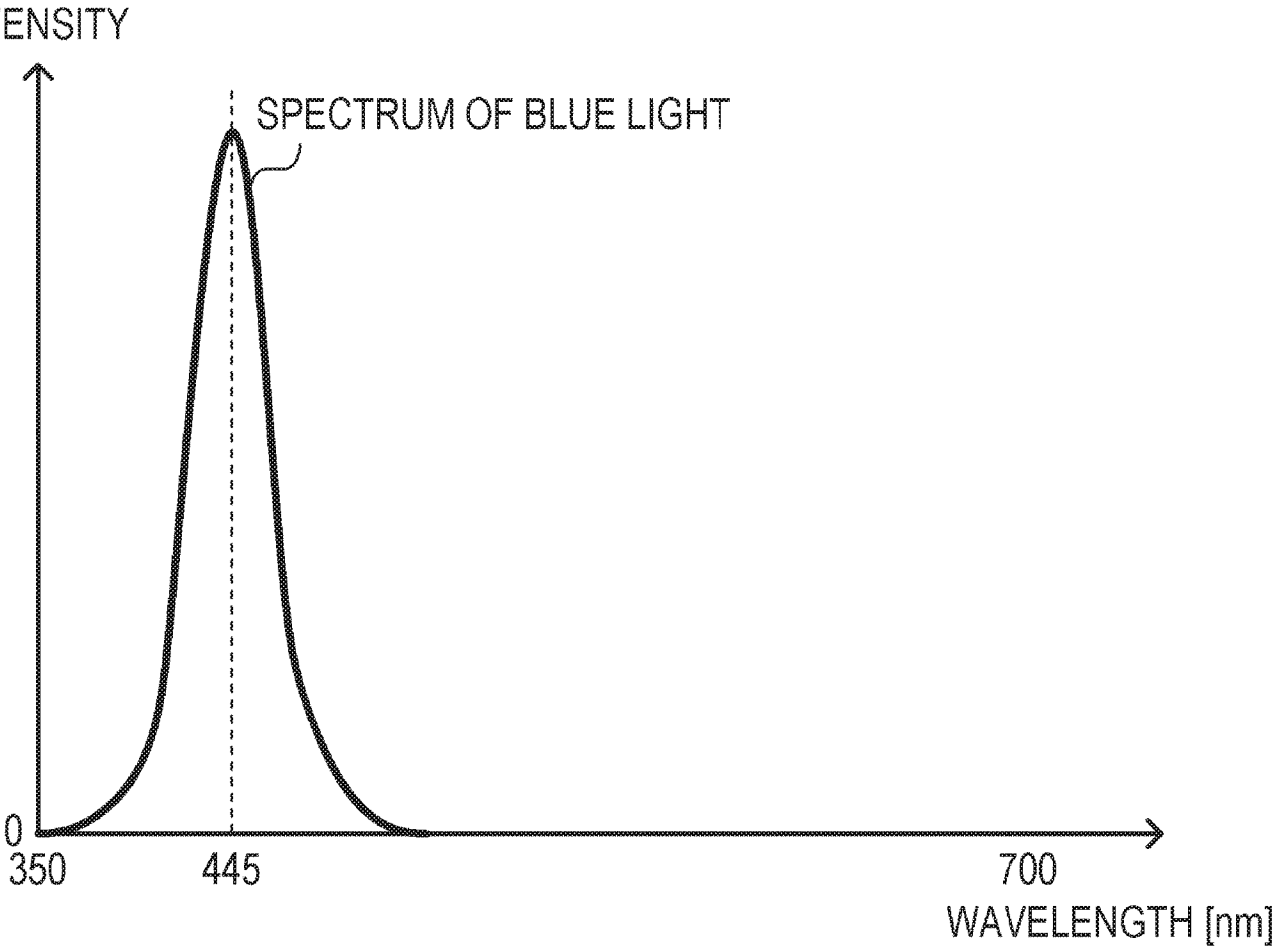
FIG. 2 is an example of a spectrum of light emitted from a light source unit according to Example 1.

The light source unit 21 emits light of a first color. In this example, the light source unit 21 emits a blue light (light of a blue color). In concrete terms, as shown in FIG. 2, the light source unit 21 emits a blue light having a spectrum (intensity distribution; spectral characteristic) of which dominant wavelength is 445 nm. The light source unit 21 includes at least one light-emitting element. For example, a light-emitting diode (LED), an organic Electro Luminescence (EL) element, a laser light source, a cold cathode tube or the like can be used as the light-emitting element. In this example, the light source unit 21 is disposed on the bottom face of the housing 25. A reflecting sheet, which reflects light, is disposed on the bottom face of the housing 25.

The spectrum of the light emitted from the light source unit 21 is not limited to the spectrum in FIG. 2. For example, the dominant wavelength of the light emitted from the light source unit 21 may be longer or shorter than 445 nm. The light emitted from the light source unit 21 may be an ultraviolet light, a green light (light having green color) or the like. The spectrum of the light emitted from the light source unit 21 is determined in advance in accordance with the characteristic of a later mentioned wavelength converting sheet 221.

The optical sheet 22 includes the wavelength converting sheet 221 and a light diffusing sheet 222.

The wavelength converting sheet (converting member) 221 converts a part of the blue light, which is emitted from the light source unit 21, into light of a second color, and emits this light. The wavelength converting sheet 221 also converts a part of the blue light, which is emitted from the light source unit 21, into light of a third color, and emits this light. Further, the wavelength converting sheet 221 emits a part of the blue light, which is emitted from the light source unit 21, without converting it.

Figure 3:
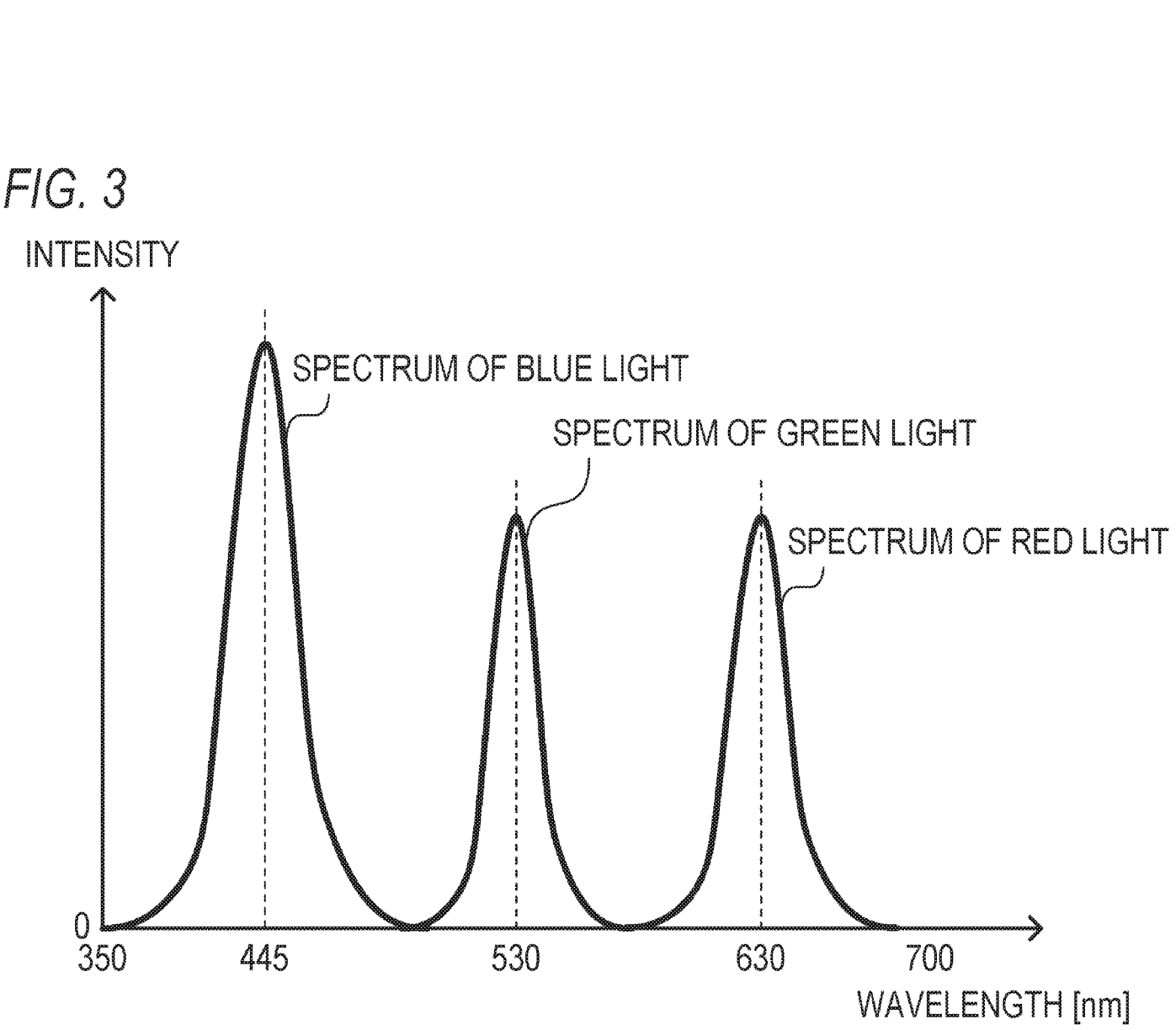
FIG. 3 is an example of a spectrum of the lights emitted from a wavelength converting sheet according to Example 1.
Figure 4:
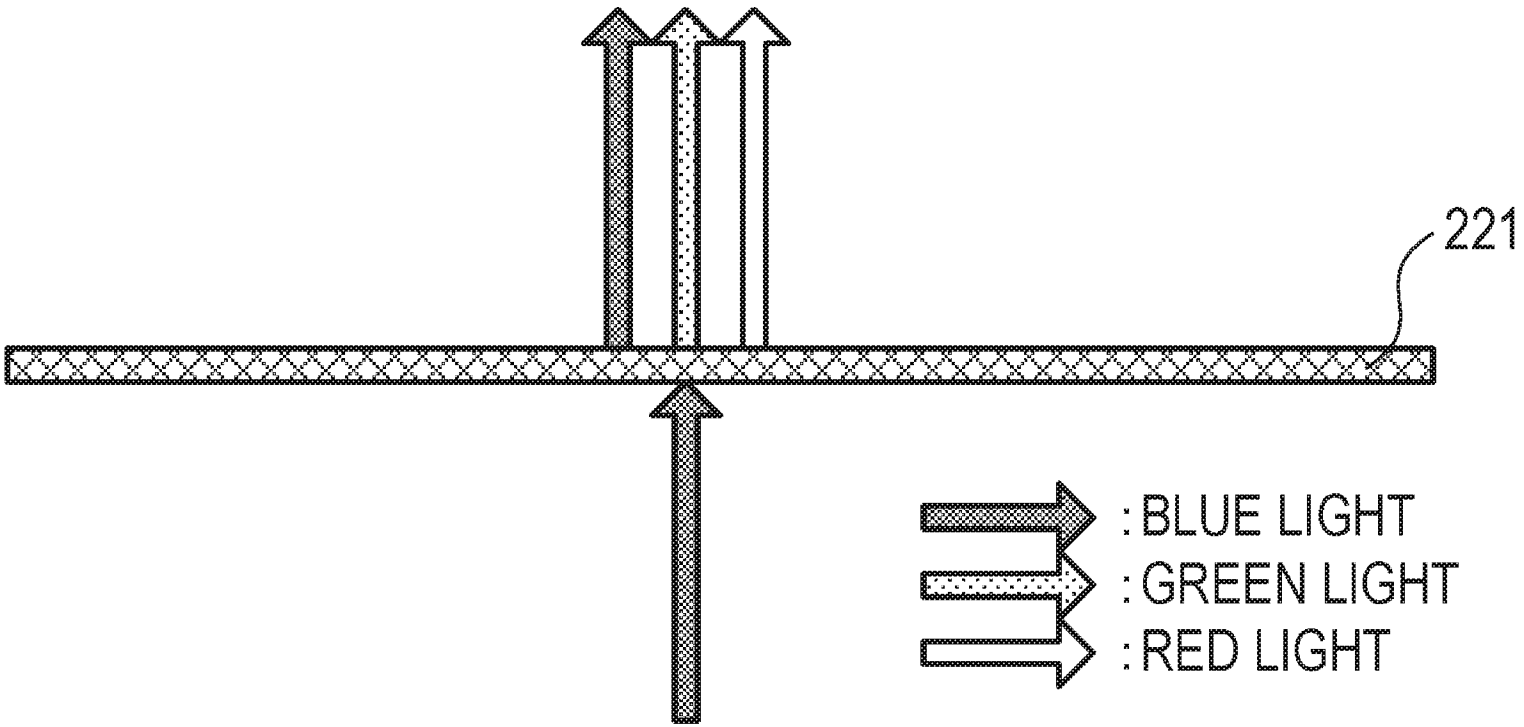
FIG. 4 is an example of lights emitted from the wavelength converting sheet according to Example 1.

The dominant wavelength of the light of a second color is longer than the dominant wavelength of the blue light, and the dominant wavelength of the light of a third color is longer than the dominant wavelength of the blue light. In other words, the dominant wavelength of the blue light is shorter than the dominant wavelength of the light of the second color, and is shorter than the dominant wavelength of the third color light. For example, one of the light of the second color and the light of the third color is a green light, and the other of the light of the second color and the light of the third color is a red light (light having a red color). In this example, the light of the second color is a green light, and the light of the third color is a red light. In concrete terms, as depicted in FIG. 3, the wavelength converting sheet 221 converts a part of the blue light, which is emitted from the light source unit 21, into a green light having a spectrum of which dominant wavelength is 530 nm, and emits this green light. Further, as depicted in FIG. 3, the wavelength converting sheet 221 converts a part of the blue light, which is emitted from the light source unit 21, into a red light having a spectrum of which dominant wavelength is 630 nm, and emits this red light. Therefore, as depicted in FIG. 3 and FIG. 4, the light, including the blue light, the green light and the red light, is emitted from the wavelength converting sheet 221.

In this example, the wavelength converting sheet 221 emits each of the green light and the red light isotropically. In other words, the green light is emitted from the wavelength converting sheet 221 in all directions, including the direction toward the display panel 10 and the direction toward the light source unit 21. In the same manner, the red light is emitted from the wavelength converting sheet 221 in all directions. A part of the blue light emitted from the light source unit 21 is reflected toward the light source unit 21 on the surface of the wavelength converting sheet 221.

A configuration example of the wavelength converting sheet 221 will be described. For example, the wavelength converting sheet 221 encloses a green converting element, which converts the blue light into the green light, and a red converting element, which converts the blue light into the red light. The green converting element and the red converting element are not especially limited, but the green converting element emits a green light by the blue light which causes excitation, and the red converting element emits a red light by the blue light which causes excitation, for example. The light that causes excitation may be called an "excitation light". In this example, the blue light emitted from the light source unit 21 is used as the excitation light of the wavelength converting sheet 221 (green converting element and red converting element).

In the wavelength converting sheet 221, the number of green converts elements, the number of red converting elements and the like are adjusted in advance. For example, the number of green converting elements, the number of red converting elements and the like are adjusted in advance, so that the white light having a predetermined color temperature is emitted from the front face of the wavelength converting sheet 221 when the light source unit 21 emits the blue light at a predetermined emission brightness (emission quantity). The number of green converting elements, the number of red converting elements and the like may be adjusted in advance, so that light having a predetermined spectrum is emitted from the front face of the wavelength converting sheet 221 when the light source unit 21 emits the blue light at a predetermined emission brightness. The predetermined spectrum is, for example, a spectrum required for the display apparatus 1 to display an image with a predetermined color gamut.

For the green converting element, a quantum dot, a phosphor or the like can be used. In the same manner, for the red converting element, a quantum dot, a phosphor or the like can be used. If the green converting element and the red converting element are both quantum dots, the wavelength converting sheet 221 may be called a "quantum dot sheet". If the green converting element and the red converting element are both phosphors, the wavelength converting sheet 221 may be called a "phosphor sheet".

The second color is not limited to green, and the third color is not limited to red. For example, red may be used as the second color, and green may be used as the third color.

In the wavelength converting sheet 221, the conversion from the first color to the third color need not be performed.

The light diffusing sheet 222 diffuses the emitted light or polarizes the emitted light, so that the brightness distribution of the emitted light of the wavelength converting sheet 221 becomes smooth. For example, the light diffusing sheet 222 is configured by a diffusing sheet, condensing sheet and polarizing sheet which are laminated. The light diffusing sheet 222 need not have all three types of sheets, or may include a diffuser and the like. An arbitrary configuration, which allows to obtain a desired light distribution, may be used as the configuration of the light diffusing sheet 222.

The wavelength converting sheet 221 may be disposed among a plurality of sheets constituting the light diffusing sheet 222. The wavelength converting sheet 221 may be disposed on the side closer to the display panel 10 than the light diffusing sheet 222. The display apparatus 1 may not include the light diffusing sheet 222.

In this example, a part of the blue light emitted from the light source unit 21 is converted into the green light by the wavelength converting sheet 221, and a part of this green light is directed to the display panel 10. A part of the blue light emitted from the light source unit 21 is converted into the red light by the wavelength converting sheet 221, and a part of this red light is directed to the display panel 10. A part of the blue light emitted from the light source unit 21 transmits through the wavelength converting sheet 221, without being converted into the green light or the red light, and is directed to the display panel 10. A part of the blue light, a part of the green light and a part of the red light is repeatedly reflected and diffused on the surface of the wavelength converting sheet 221, the surface of the light diffusing sheet 222, and the reflecting sheet disposed in the housing 25 and the like, and are directed to the display panel 10.

Here the emitted light of the wavelength converting sheet 221 changes in accordance with the change of the emission brightness of the light source unit 21. For example, if the emission brightness of the light source unit 21 changes, the number of times when the blue light emitted from the light source unit 21 collides with the green converting element and the red converting element (collision frequency) changes. As the plane parallel with the screen becomes more distant from the light source unit 21, the distance for the blue light, emitted from the light source unit 21, to transmit through the wavelength converting sheet 221, increases. And as the emission brightness of the light source unit 21 changes, the maximum distance for the blue light, emitted from the light source unit 21, to reach (the arrival position) on the plane parallel with the screen, changes. Further, depending on the change of the collision frequency, the change of the maximum distance to the arrival position and the like, the ratio of the blue light, with respect to the green light and the red light in the emitted light, changes. The emitted light also changes depending on the change of the characteristic of the wavelength converting sheet 221. For example, the characteristic of the wavelength converting sheet 221 is subject to age deterioration due to heat, humidity and the like. If the emitted light changes, the light which is emitted from the light-emitting unit 20 to the display panel 10 changes, and the colors of the image displayed by the display apparatus 1 (display colors) change.

Each of a first brightness sensor 23 and a second brightness sensor 24 is a detection unit which detects the brightness of light, and outputs a detected value in accordance with the detected brightness. The color of the detection target light of the first brightness sensor 23 is different from that of the second brightness sensor 24. In this example, the first brightness sensor 23 detects the brightness of the blue light emitted from the light source unit 21, and outputs a first detected value in accordance with the detected brightness. The second brightness sensor 24 detects the brightness of the green light obtained by the wavelength converting sheet 221, and outputs a second detected value in accordance with the detected brightness.

Figure 5:
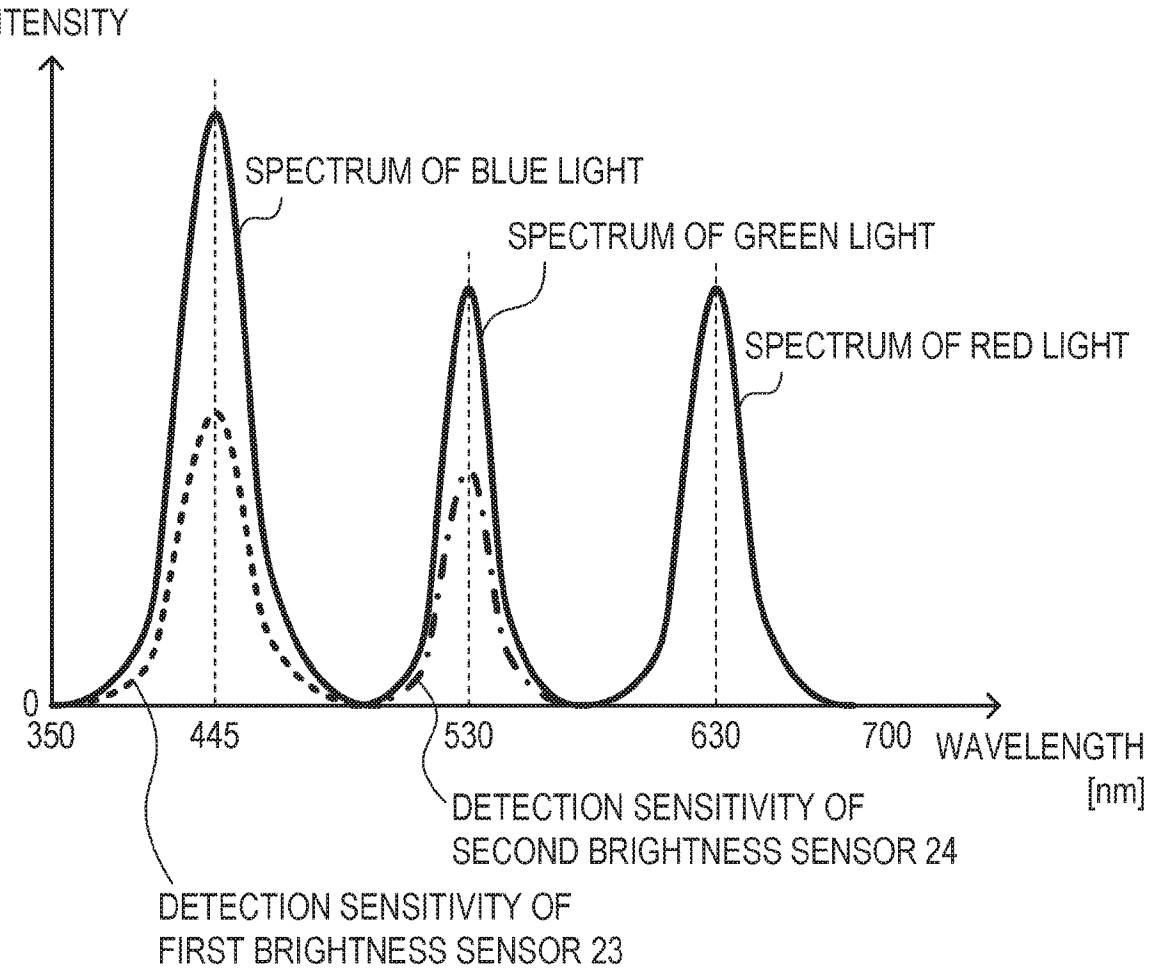
FIG. 5 is an example of the detection sensitivity of a first brightness sensor and that of a second brightness sensor according to Example 1.

In this example, as illustrated in FIG. 5, the first brightness sensor 23 detects the intensity of light having the dominant wavelength of the blue light (445 nm) emitted from the light source unit 21 at the highest detection sensitivity. The detection sensitivity of the first brightness sensor 23 is not especially limited. For example, the first brightness sensor 23 may detect the intensity of the light having a wavelength near the dominant wavelength (445 nm) at the highest detection sensitivity. The first brightness sensor 23 may detect the intensity of light having another wavelength within the wavelength range corresponding to the half width of the spectrum of the blue light at the highest detection sensitivity. The first brightness sensor 23 may also detect the intensity of light having another wavelength within at least 440 nm and less than 480 nm of the wavelength range at the highest detection sensitivity.

Further, in this example, as illustrated in FIG. 5, the second brightness sensor 24 detects the intensity of light having the dominant wavelength of the green light (530 nm) obtained by the wavelength converting sheet 221 at the highest detection sensitivity. The detection sensitivity of the second brightness sensor 24 is not especially limited. For example, the second brightness sensor 24 may detect the intensity of the light having a wavelength near the dominant wavelength (530 nm) at the highest detection sensitivity. The second brightness sensor 24 may detect the intensity of light having another wavelength within the wavelength range corresponding to the half width of the spectrum of the blue light at the highest detection sensitivity. The second brightness sensor 24 may also detect the intensity of the light having another wavelength within at least 480 nm and less than 580 nm of the wavelength range at the highest detection sensitivity.

In the case when the second color is red, the intensity of the light having the dominant wavelength of the red light (630 nm) obtained by the wavelength converting sheet 221 is detected at the highest detection sensitivity. The second brightness sensor 24 may detect the intensity of the light having a wavelength near the dominant wavelength (630 nm) may be detected at the highest detection sensitivity. The second brightness sensor 24 may detect the intensity of the light having another wavelength within the wavelength range corresponding to the half width of the spectrum of the red light at the highest detection sensitivity. The second brightness sensor 24 may detect the intensity of the light having another wavelength within at least 580 nm and not more than 700 nm of the wavelength range at the highest detection sensitivity.

Although details will be provided later, the color correction processing to reduce the change of the display colors is performed in this example. In this example, the light emitted from the light source unit 21 and the light obtained by the wavelength converting sheet 221 are detected independently, hence high precision color correction processing can be implemented by using these detection results. For example, the change of the emitted light (emitted light of the wavelength converting sheet 221) caused by the change of the emission brightness of the light source unit 21 can be detected at high accuracy, and the change of the display colors caused by the change of the emission brightness of the light source unit 21 can be reduced at high accuracy.

Figure 6:
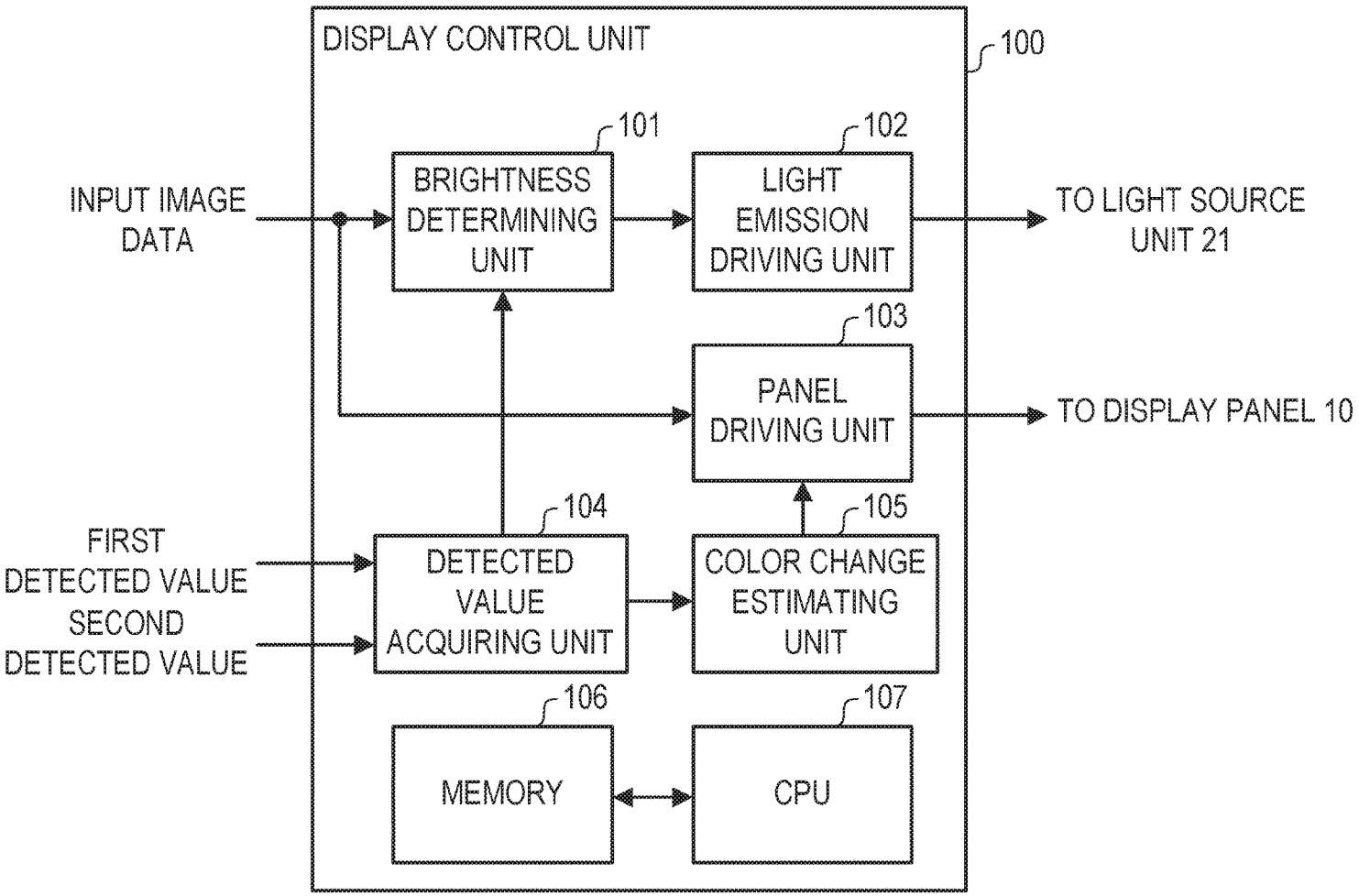
FIG. 6 is a configuration example of a display control unit according to Example 1.

FIG. 6 is a block diagram depicting a configuration example of the display control unit (display control circuit board) 100. The display control unit 100 includes a brightness determining unit 101, a light emission driving unit 102, a panel driving unit 103, a detected value acquiring unit 104, a color change estimating unit 105, a memory 106, and a central processing unit (CPU) 107. The memory 106 stores information (e.g. program, parameter) that is used for the display control unit 100. The CPU 107 controls the processing of at least a part of the functional units of the display control unit 100. For example, the CPU 107 reads a program, which is recorded in the memory 106, from the memory 106, and executes the program, so as to control the processing of at least a part of the functional units. The processing of at least a part of the functional units may be implemented by the CPU 107.

The display apparatus 1 (display control unit 100) acquires image data from an outside source using such an interface as High-Definition Multimedia Interface (HDMI). Hereafter the image data acquired from an outside source is called "input image data".

The brightness determining unit 101 determines the emission brightness of the light source unit 21 based on the input image data, and transmits a brightness signal in accordance with the determined emission brightness to the light emission driving unit 102. The method of determining the emission brightness is not especially limited. For example, the brightness determining unit 101 determines the lower emission brightness to be lower as the brightness of the input image data is lower. The brightness determining unit 101 may transmit the brightness signal in accordance with a predetermined emission brightness to the light emission driving unit 102. The brightness determining unit 101 may determine the emission brightness considering the first detected value or the like. For example, the brightness determining unit 101 may determine the emission brightness so that a target value is obtained as the first detected value. The target value is the first detected value corresponding to the emission brightness based on the input image data, the first detected value corresponding to a predetermined emission brightness or the like.

The light emission driving unit 102 transmits a light emission driving signal, in accordance with the brightness signal received from the brightness determining unit 101, to the light source unit 21. Thereby the light source unit 21 emits light at an emission brightness in accordance with the light emission driving signal received from the light emission driving unit 102.

The detected value acquiring unit 104 acquires the first detected value outputted from the first brightness sensor 23 and the second detected value outputted from the second brightness sensor 24. Then the detected value acquiring unit 104 outputs the acquired detected values (first detected value and second detected value) to the color change estimating unit 105. If the detected value acquiring unit 104 acquired an analog value as the detected value, the detected value acquiring unit 104 converts the acquired analog value into a digital value (A/D conversion processing), and outputs the digital value.

The panel driving unit 103 generates the display image data from the input image data, and outputs the display image data to the display panel 10. Thereby the transmittance of the display panel 10 is controlled to a transmittance based on the display image data. In concrete terms, the display panel 10 includes a plurality of display elements, and the transmittance of each display element is controlled to a transmittance based on the display image data. As a result, the light emitted from the light-emitting unit 20 transmits through the display panel 10 at the transmittance based on the display image data, whereby the image based on the display image data is displayed on the screen. In this example, the panel driving unit 103 generates the display image data by correcting the input image data using the correction parameters outputted from the color change estimating unit 105.

Figure 7:
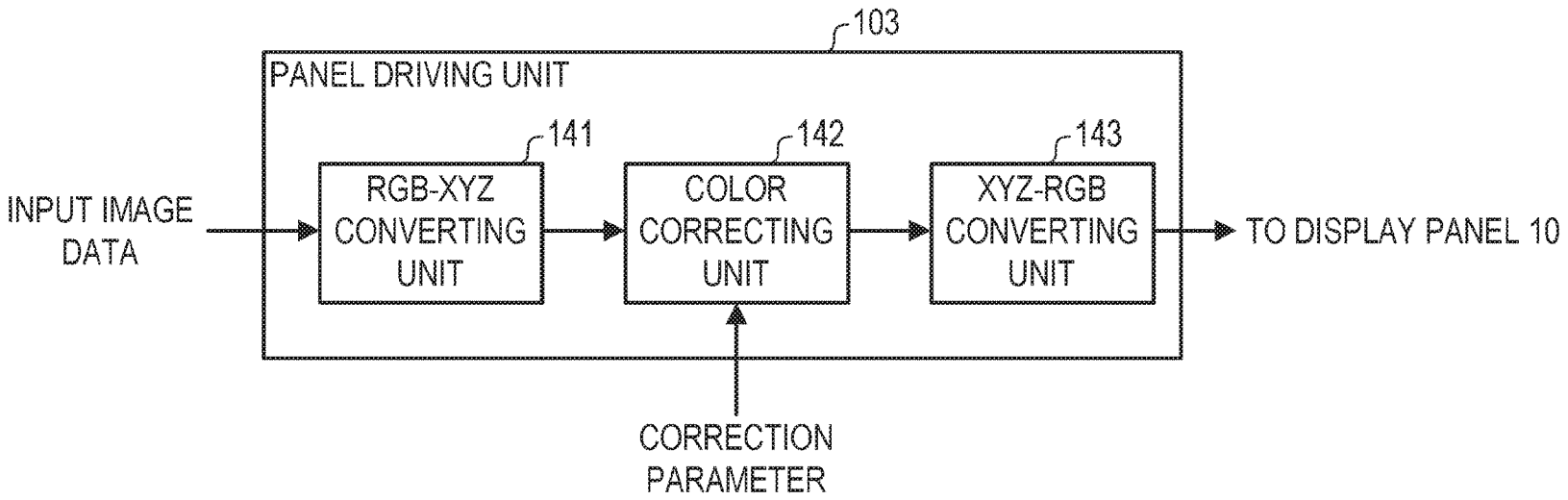
FIG. 7 is a configuration example of a panel driving unit according to Example 1.

FIG. 7 is a block diagram depicting a configuration example of the panel driving unit 103. The panel driving unit 103 includes an RGB-XYZ converting unit 141, a color correcting unit 142, and an XYZ-RGB converting unit 143.

The RGB-XYZ converting unit 141 converts each pixel value of the input image data into XYZ tristimulus values (X value, Y value, Z value)=(Xs, Ys, Zs). In this example, the pixel value of the input image data has RGB values (R value, G value, B value)=(Rs, Gs, Bs). The RGB-XYZ converting unit 141 converts the RGB values (Rs, Gs, Bs) into the XYZ tristimulus values (Xs, Ys, Zs) using the following Expression 1. Matrix M of Expression 1 is determined based on the white point that is set, for example.

[Math. 1]

$$\begin{pmatrix} Xs \\ Ys \\ Zs \end{pmatrix} = M \begin{pmatrix} Rs \\ Gs \\ Bs \end{pmatrix} \quad \text{(Expression 1)}$$

$$M = \begin{pmatrix} M11 & M12 & M13 \\ M21 & M22 & M23 \\ M31 & M32 & M33 \end{pmatrix}$$

The color correcting unit 142 corrects each of the XYZ tristimulus values (Xs, Ys, Zs) acquired by the RGB-XYZ converting unit 141 using the correction parameters outputted from the color change estimating unit 105 (color correcting processing). In this example, the color correcting unit 142 corrects the XYZ tristimulus values (Xs, Ys, Zs) into the XYZ tristimulus values (Xc, Yc, Zc) using the following Expression 2. In Expression 2, "α" denotes a correction parameter to correct the X value Xs, "β" denotes a correction parameter to correct the Y value Ys, and "γ" denotes a correction parameter to correct the Z value Zs. The correction parameters α, β, and γ are correction parameters to reduce the above mentioned change of the display colors. The initial values of the correction parameters α, β, and γ are "1" respectively, and when a new correction parameter is acquired from the color change estimating unit 105, the color correcting unit 142 updates the correction parameter used for the color correction processing to the acquired correction parameter.

[Math. 2]

$$\begin{pmatrix} Xc \\ Yc \\ Zc \end{pmatrix} = C \begin{pmatrix} Xs \\ Ys \\ Zs \end{pmatrix} \quad \text{(Expression 2)}$$

$$C = \begin{pmatrix} \alpha & 0 & 0 \\ 0 & \beta & 0 \\ 0 & 0 & \gamma \end{pmatrix}$$

The XYZ-RGB converting unit 143 converts each of the XYZ tristimulus values (Xc, Yc, Zc), after the correction by the color correcting unit 142, into the pixel value of the display image data. In this example, the pixel values of the display image data are the RGB values (Rc, Gc, Bc). The XYZ-RGB converting unit 143 converts the XYZ tristimulus values (Xc, Yc, Zc) into the RGB values (Rc, Gc, Bc) using the following Expression 3.

[Math. 3]

$$\begin{pmatrix} Rc \\ Gc \\ Bc \end{pmatrix} = M^{-1} \begin{pmatrix} Xc \\ Yc \\ Zc \end{pmatrix} \quad \text{(Expression 3)}$$

The method of generating the display image data is not limited to the above mentioned. For example, the conversion into the XYZ tristimulus values, the conversion from the XYZ tristimulus values or the like need not be performed. Correction parameters which are different from the correction parameters to correct the XYZ tristimulus values may be used for the color correcting processing. For example, correction parameters to correct the RGB values may be used. The pixel value of the input image data, the pixel value of the display image data and the like are not limited to the RGB values. For example, YCbCr values may be used as the pixel values.

The color change estimating unit 105 determines the correction parameters α, β, and γ based on the detected values (first detected value and second detected value) outputted from the detected value acquiring unit 104, and outputs the correction parameters α, β, and γ to the panel driving unit 103. In this example, the correspondence information related to the correspondence of the first detected value, the second detected value, and the correction parameters α, β, and γ is provided in advance. Then the correction parameters α, β, and γ are determined based on the detected values outputted from the detected value acquiring unit 104 and the correspondence information. The timing of the processing to determine the correction parameters α, β, and γ, the frequency of this processing and the like are not especially limited. For example, the processing to determine the correction parameters α, β, and γ may be performed at every predetermined time. The timing of the processing, the frequency of the processing and the like may be changed based on the driving time of the display apparatus 1. The user may specify the timing of the processing, the frequency of the processing and the like.

Figure 8:
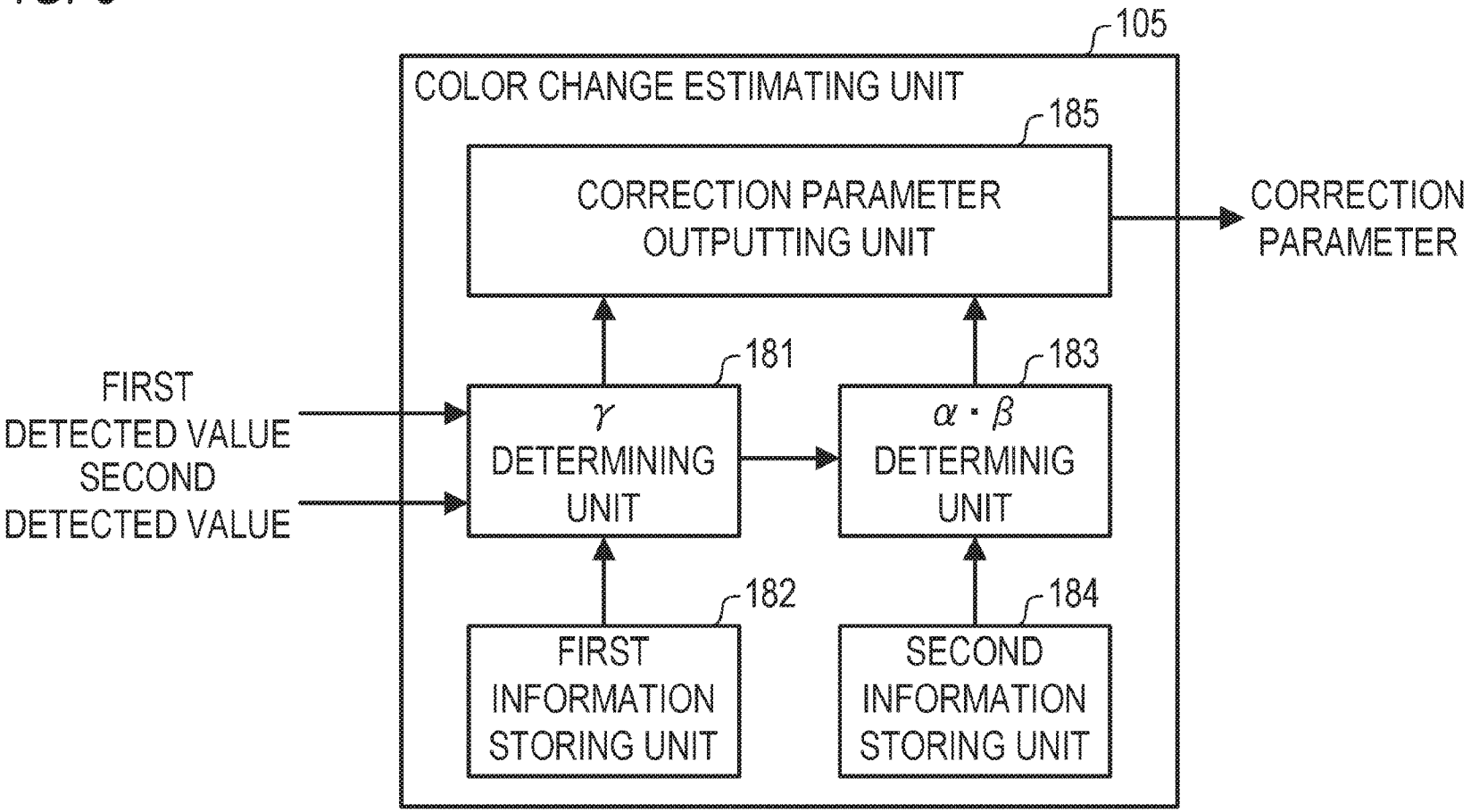
FIG. 8 is a configuration example of a color change estimating unit according to Example 1.

FIG. 8 is a block diagram depicting a configuration example of the color change estimating unit 105. The color change estimating unit 105 includes a γ determining unit 181, a first information storing unit 182, an α·β determining unit 183, a second information storing unit 184, and a correction parameter outputting unit 185.

Figure 9:
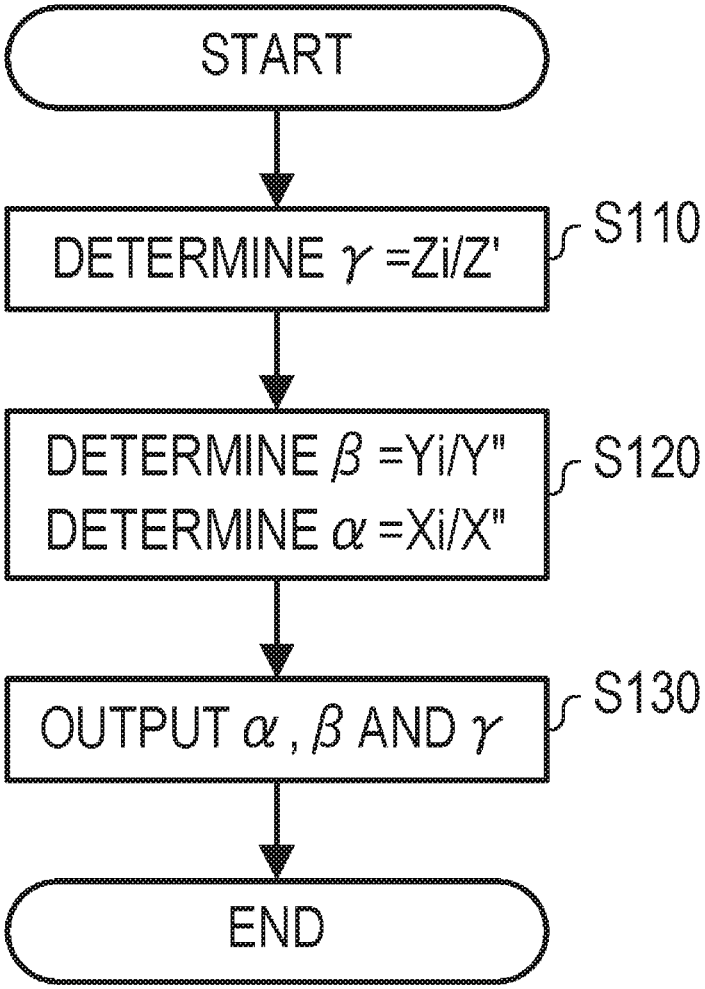
FIG. 9 is an example of the processing flow of the color change estimating unit according to Example 1.

FIG. 9 is a flow chart depicting an example of a processing flow of the color change estimating unit 105. The processing of each functional unit of the color change estimating unit 105 will be described with reference to FIG. 9.

First in S110, the γ determining unit 181 determines a correction parameter γ. The first information storing unit 182 stores the first information, which is a part of the correspondence information. The first information relates to the change of the emitted light (light emitted from the wavelength converting sheet 221; light emitted from the light-emitting unit 20) with respect to the change of the emission brightness of the light source unit 21. In this example, as shown in FIG. 10, the first information indicates the correspondence relationship of the first detected value Rbf, the second detected value Rgf, and the XYZ tristimulus values (Xf, Yf, Zf) of the emitted light, in the case when the characteristic of the wavelength converting sheet 221 is a predetermined characteristic. The predetermined characteristic is a characteristic which is set when the display apparatus 1 is manufactured. The second detected value Rgf is a second detected value when the change of the emitted light, caused by the change of emission brightness of the light source unit 21, is considered. The XYZ tristimulus values (Xf, Yf, Zf) are the XYZ tristimulus values when the change of the emitted light, caused by the change of the emission brightness of the light source unit 21, is considered. In this example, the γ determining unit 181 determines the correction parameter γ based on the first detected value Rb' outputted from the detected value acquiring unit 104 and the first information.

In concrete terms, the γ determining unit 181 acquires the second detected value Rgf=Rg' corresponding to the first detected value Rbf=Rb' and the XYZ tristimulus values (Xf, Yf, Zf)=(X', Y', Z') corresponding to the first detected value Rbf=Rb' from the first information. Then the γ determining unit 181 determines the ratio of the Z value Z' and a predetermined Z value, as the correction parameter γ. The predetermined Z value is not especially limited, but in this example, the predetermined Z value is a Z value Zi of the XYZ tristimulus values (Xi, Yi, Zi) of the emitted light, in the case when the characteristic of the wavelength converting sheet 221 is a predetermined characteristic, and the emission brightness of the light source unit 21 is a predetermined brightness. The γ determining unit 181 determines the ratio Zi/Z' as the correction parameter γ. Then the γ determining unit 181 outputs the second detected value Rg', the XYZ tristimulus values (X', Y', Z') and the second detected value Rg" outputted from the detected value acquiring unit 104 to the α·β determining unit 183, and outputs the correction parameter γ to the correction parameter outputting unit 185.

FIG. 11 shows the first detected value Rbi, the second detected value Rgi, and the XYZ tristimulus values (Xi, Yi, Zi) when the characteristic of the wavelength converting sheet 221 is a predetermined characteristic, and the emission brightness of the light source unit 21 is a predetermined brightness. The information in FIG. 11 may be a part of the first information in FIG. 10, or may be provided as information that is separate from the first information.

Now a case of the first detected value Rb'=101 is considered. In this case, the second detected value Rg'=106, the X value X'=105, the Y value Y'=106, and the Z value Z'=101 are acquired from the first information in FIG. 10. From the Z value Z'=101 and the Z value Zi=101 in FIG. 11, the correction parameter γ=Zi/Z'=101/101=1 is determined.

Figure 12:
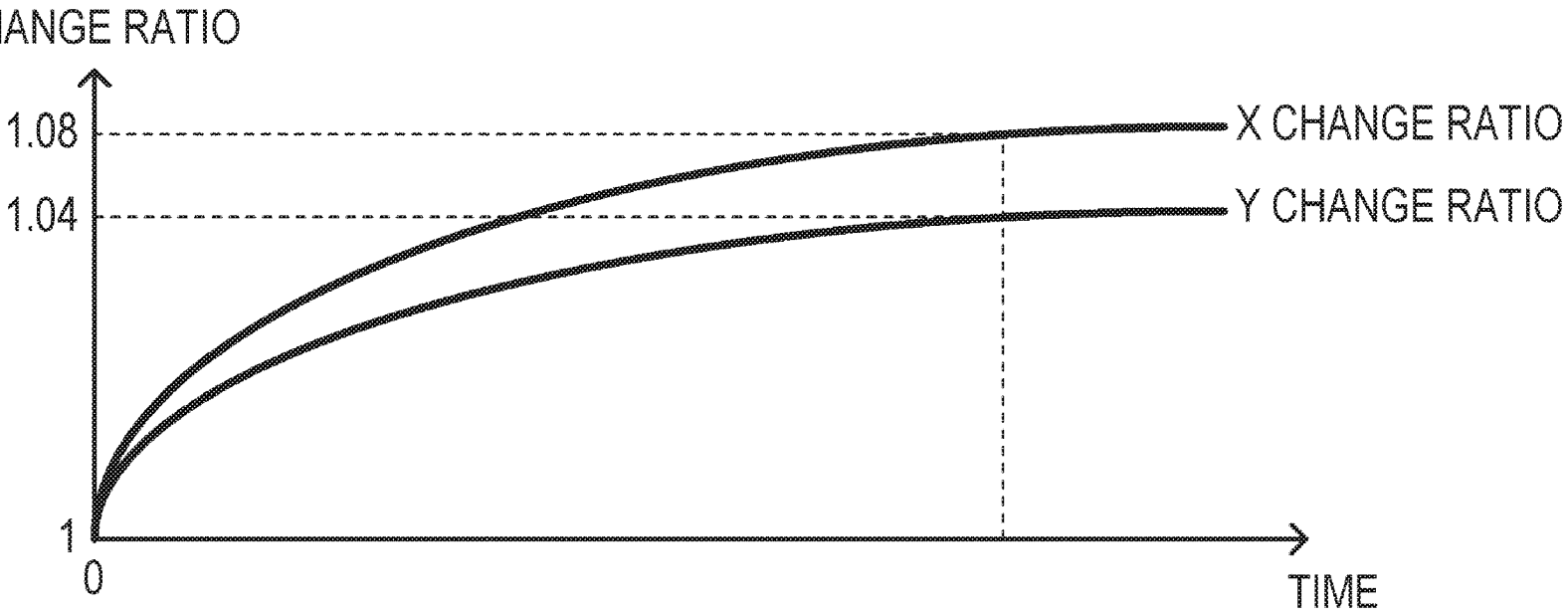
FIG. 12 is an example of second information according to Example 1.

Then in S120, the α·β determining unit 183 determines the correction parameters α and β, and outputs the correction parameters α and β to the correction parameter outputting unit 185. The second information storing unit 184 stores the second information, which is a part of the above mentioned correspondence information. The second information is information related to the change of the emitted light with respect to the change of the characteristics of the wavelength converting sheet 221. In this example, as shown in FIG. 12, the second information indicates the correspondence relationship between; the change rate of the X value of the emitted light corresponding to the change of the characteristic of the wavelength converting sheet 221 from a predetermined characteristic; and the change rate of the Y value of the emitted light corresponding to the change of the characteristic of the wavelength converting sheet 221 from a predetermined characteristic. In this example, the α·β determining unit 183 determines the correction parameters α and β based on the second detected values Rg' and Rg", the XYZ tristimulus values (X', Y', Z') and the second information.

In concrete terms, the α·β determining unit 183 determines the Y value Y" of the emitted light for which the change of the characteristic of the wavelength converting sheet 221 is considered based on the second detected values Rg' and Rg" and the Y value Y'. In this example, the second detected value Rg" is a constant multiple of the brightness of the green light obtained by the wavelength converting sheet 221, and the α·β determining unit 183 determines the Y value Y" so that Rg"/Rg'=Y"/Y' is satisfied. Then the α·β determining unit 183 determines the ratio of the Y value Y" and a predetermined Y value as the correction parameter β. The predetermined Y value is not especially limited, but in this example, the Y value Yi is used as the predetermined Y value. The α·β determining unit 183 determines the ratio Yi/Y" as the correction parameter β.

Here the case when the second detected value Rg'=106, the second detected value Rg"=110, the Y value Y'=106 and the Y value Yi=106 is considered. In this case, from the second detected value Rg'=106, the second detected value Rg"=110 and the Y value Y'=106, the Y value Y"=(Rg"/Rg')×Y'=(110/106)×106=110 is determined. Then from the Y value Y"=110 and the Y value Yi=106, the correction parameter β=Yi/Y"=106/110=0.96 is determined.

Further, the α·β determining unit 183 determines the X value X" of the emitted light, for which the change of the characteristic of the wavelength converting sheet 221 are considered, based on the X value X', the Y values Y' and Y", and the second information. The ratio Y"/Y' corresponds to the change ratio of the Y value (Y change ratio) of the emitted light corresponding to the change of the characteristic of the wavelength converting sheet 221 from a predetermined characteristic. The α·β determining unit 183 acquires the X change ratio X"/X' corresponding to the Y change ratio Y"/Y' from the second information. The X change ratio is a change ratio of the X value of the emitted light corresponding to the change of the characteristic of the wavelength converting sheet 221 from a predetermined characteristic. Then the α·β determining unit 183 determines the X value X" based on the X change ratio X"/X' and the X value X'. Then the α·β determining unit 183 determines the ratio of the X value X" and the predetermined X value as the correction parameter α. The predetermined X value is not especially limited, but in this example, the X value Xi is used as the predetermined X value. The α·β determining unit 183 determines the ratio Xi/X" as the correction parameter α.

Here a case when the X value X'=105, the X value Xi=105, the Y value Y'=106, and the Y value Y"=110 is considered. In this case, the X change ratio X"/X'=1.08 corresponding to the Y change ratio Y"/Y'=110/106=1.04 is obtained from the second information in FIG. 12. From the X change ratio X"/X'=1.08 and the X value X'=105, the X value X"=1.08×105=113 is determined. And from the X value X"=113 and the X value Xi=105, the correction parameter α=Xi/X"=105/113=0.93 is determined.

Then in S130, the correction parameter outputting unit 185 outputs the correction parameters α, β and γ, determined by the processing operations in S110 and S120, to the panel driving unit 103.

In the case when the second color is red, the "X value" in the above description on the processing flow is replaced with the "Y value", and the "Y value" in the above description is replaced with the "X value". The "correction parameter α" in the above description is regarded as the "correction parameter β", and the "correction parameter β" in the above description is replaced with the "correction parameter α".

As described above, according to this example, the display image data is generated by correcting the input image data based on the first detected value and the second detected value. Thereby the change of the display colors caused by the change of the characteristic of the wavelength converting member and the change of the display colors caused by the change of the emission brightness of the light source unit can be reduced at high accuracy.

The display apparatus 1 need not include the color change estimating unit 105. The determination of the correction parameters may be omitted, and the panel driving unit 103 may correct the input image data directly using the first detected value and the second detected value. If the change of the display colors caused by the change of the characteristic of the wavelength converting sheet 221 can be reduced, the change of the display colors caused by the change of the emission brightness of the light source unit 21 need not be reduced.

The display apparatus 1 may include one light source unit 21, or may include a plurality of light source units 21. In the case when a plurality of light source units 21 emit light at a common emission brightness, a common correction parameter for the entire screen may be determined. In many cases, the change of the characteristic of the wavelength converting sheet 221 is approximately the same among the regions of the screen. Therefore if the input image data is corrected using a common correction parameter for the entire screen, the change of the display colors can be reduced at high accuracy. Further, if a common correction parameter is used for the entire screen, the processing load to determine the correction parameter, the processing load to perform the color correction processing and the like can be reduced.

The first information and the second information are not limited to the above mentioned information respectively. For example, in the first information, each change amount of the XYZ tristimulus values may be indicated instead of the XYZ tristimulus values. In the second information, the X value after the change may be indicated instead of the change ratio of the X value. In the second information, the Y value after the change may be indicated instead of the change ratio of the Y value. The correspondence information need not be a combination of the first information and the second information. For example, the correspondence relationship of the first detected value, the second detected value and the correction parameter may be indicated in the correspondence information. In concrete terms, in the correspondence information, the first detected value and the second detected value may be indicated as input values, and the correction parameter may be indicated as an output value. The various information may be expressed as a table or as functions.

Example 2

Embodiment 2 of the present invention will be described. In this example, a case when the display apparatus has a plurality of light source units and the emission brightness of each light source unit is independently controller will be described. The independent control of the emission brightness may be called "local dimming control". When the local dimming control is performed, the change of the display colors varies depending on the region of the screen. This example describes a case of independently determining the correction parameter for each of a plurality of regions of the screen, so that the change of display colors is reduced at high accuracy, even when the local dimming control is performed. In the following, aspects (e.g. configuration, processing) that are different from Example 1 will be described in detail, and description on the same aspects as Example 1 will be omitted.

Figure 13:
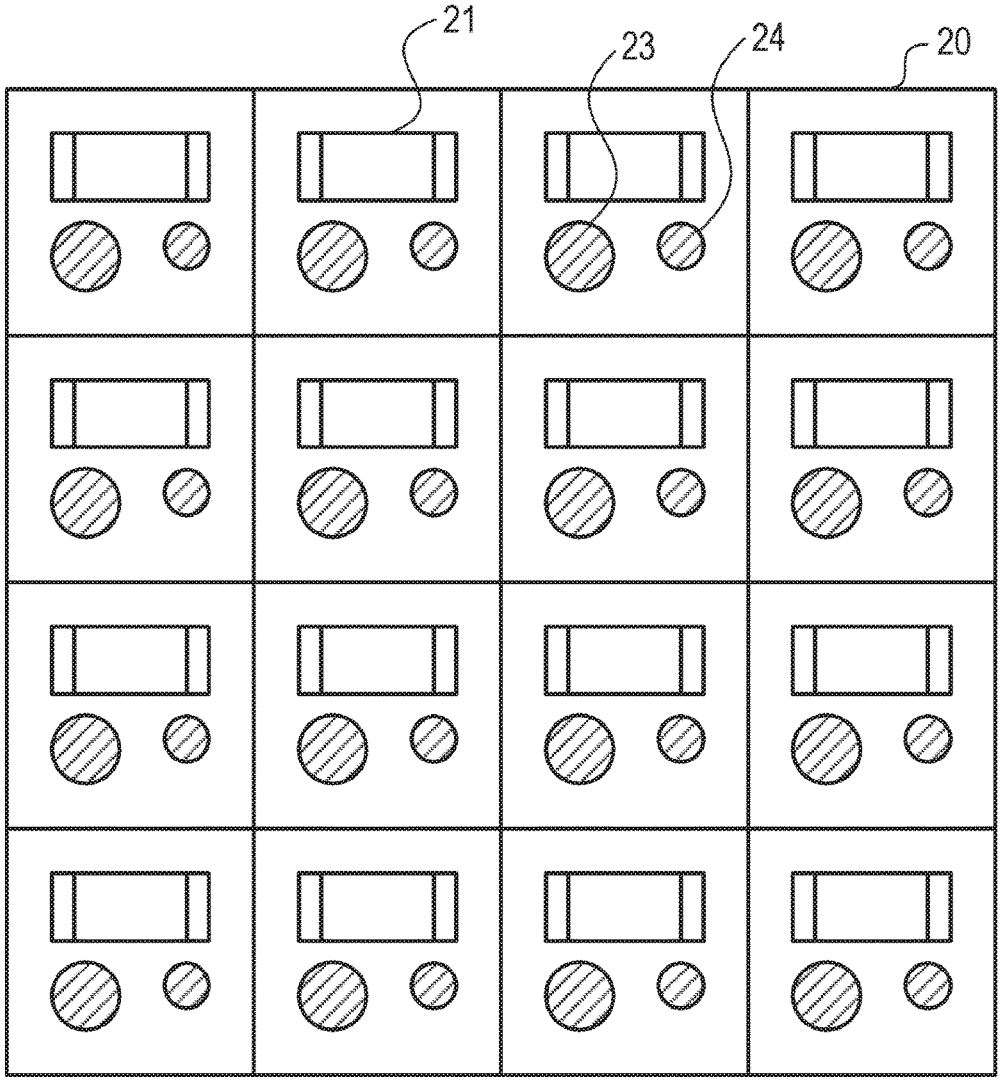
FIG. 13 is a configuration example of a light-emitting unit according to Example 2.

FIG. 13 shows a configuration example of the light-emitting unit 20 according to this example. FIG. 13 is an example when the light-emitting unit 20 is viewed in the direction vertical to the screen. In FIG. 13, the optical sheet 22 and the housing 25 are omitted. As illustrated in FIG. 13, the light-emitting unit 20, according to this example, includes: a plurality of light source units 21; a plurality of first brightness sensors 23 which correspond to the plurality of light source units 21 respectively; and a plurality of second brightness sensors 24 which correspond to the plurality of light source units 21 respectively. In the example in FIG. 13, the light-emitting unit 20 includes 16 light source units 21, 16 first brightness sensors 23, and 16 second brightness sensors 24. In the example in FIG. 13, the 16 light source units 21, the 16 first brightness sensors 23 and the 16 second brightness sensors 24 are disposed in a 4×4 matrix.

The number of the plurality of light source units 21 may be more or less than 16. The number of rows of the matrix, in which the plurality of light source units 21 are disposed, may be more or less than 4. The number of columns of the matrix may be more or less than 4. The arrangement of the plurality of light source units 21 is not limited to a matrix. For example, the plurality of light source units 21 may be disposed in a zigzag format. In the same manner, the number of the plurality of first brightness sensors 23, the arrangement of the plurality of first brightness sensors 23, the number of the plurality of second brightness sensors 24, and the arrangement of the plurality of second brightness sensors 24 are not especially limited either. The light-emitting unit 20 may further include a sensor to detect the red light. In this case, it is preferable that the number of the first brightness sensors 23 and the number of the second brightness sensors 24 are greater than the number of the sensors to detect the red light respectively.

The brightness determining unit 101 individually determines the emission brightness of each of the plurality of light source units 21 based on the input image data. Then for each of the plurality of light source units 21, the brightness determining unit 101 outputs the brightness signal, in accordance with the determined emission brightness, to the light emission driving unit 102. For example, a plurality of regions (reference regions) of the screen are corresponded to the plurality of light source units 21 respectively. For each of the plurality of light source units 21, the brightness determining unit 101 determines the emission brightness based on the image data (a part of the input image data) of the reference region. The plurality of reference regions are a plurality of sub-regions constituting the screen.

A reference region is not limited to a sub-region. For example, a reference region may be distant from another reference region, or at least a part of a reference region may overlap with at least a part of another reference region. At least two light source units may correspond to one reference region. In other words, each of the plurality of light source units 21 may correspond to one of at least two reference regions, which is less than the number of the plurality of light source units 21.

For each of the plurality of light source units 21, the light emission driving unit 102 transmits a light emission driving signal, in accordance with the brightness signal received from the brightness determining unit 101, to the light source unit 21. Thereby each of the plurality of light source units 21 emits light at the emission brightness, in accordance with the light emission driving signal received from the light emission driving unit 102. As a result, in this example, the emission brightness of each of the plurality of light source units 21 is independently controlled.

The color change estimating unit 105 according to this example determines a plurality of correction parameters which correspond to the plurality of regions (correction regions) in the screen respectively. The plurality of correction parameters are determined based on a plurality of first detected values, which are outputted from the plurality of first brightness sensors 23 respectively, and a plurality of second detected values, which are outputted from the plurality of second brightness sensors 24 respectively. For example, a plurality of correction regions, which correspond to the plurality of light source units 21 (plurality of first brightness sensors 23; plurality of second brightness sensor 24) respectively, are determined in advance, and for each of the plurality of correction regions, the correction parameter is determined in the same method as Example 1. The plurality of correction regions are a plurality of sub-regions constituting the screen, for example.

The method of determining the correction parameter is not especially limited. Here a case of using a plurality of correction regions, which correspond to the plurality of light source units 21 (plurality of first brightness sensors 23; plurality of second brightness sensors 24) respectively, are considered. In this case, it is preferable to determine the correction parameter of each correction region considering not only the first detected value of the first brightness sensor 23 corresponding to this correction region, but also the first detected values of the peripheral first brightness sensors 23. Further, it is preferable to determine the correction parameter of this correction region, also considering the distance from the correction region to the first brightness sensors 23 (first brightness sensor 23 corresponding to this correction region, peripheral first brightness sensors 23 and the like). In the same manner, it is preferable to consider the detected values of the peripheral second brightness sensors 24, the distance from the correction region to the second brightness sensors 24 and the like.

A correction region is not limited to a sub-region. For example, a correction region may be distant from another correction region, or at least a part of a correction region may overlap with at least a part of another correction region. The correction region need not correspond to the light source unit 21. The number of the plurality of correction regions may be more or less than the number of the plurality of light source units 21. The correction region may be or may not be the same as the reference region. The correction region may be a region constituted by one pixel or a plurality of pixels.

The panel driving unit 103 according to this example generates the display image data by correcting the input image data using the correction parameters which correspond to the plurality of correction regions respectively. For example, for each pixel, the panel driving unit 103 corrects the pixel value of this pixel using a correction parameter corresponding to this pixel. For example, as a correction parameter corresponding to a pixel belonging to one correction region, a correction parameter determined for this correction region can be used. A correction parameter corresponding to a pixel which does not belong to a correction region can be obtained by interpolation using a plurality of correction parameters. A correction parameter corresponding to a pixel belonging to at least two correction regions, that is, a correction parameter corresponding to a pixel belonging to a region where a plurality of correction regions overlap, can also be obtained by interpolation using a plurality of correction parameters.

As described above, according to this example, a plurality of correction parameters corresponding to a plurality of correction regions respectively are determined based on a plurality of first detected values outputted from a plurality of first brightness sensors respectively, and a plurality of second detected values outputted form a plurality of second brightness sensors respectively. Then the display image data is generated by correcting the input image data using the plurality of parameters. Thereby the change of the display colors can be reduced at high accuracy, even if the local dimming control is performed.

Each functional unit of Examples 1 and 2 may or may not be standalone hardware. The functions of at least two functional units may be implemented by common hardware, or each of a plurality of functions of one functional unit may be implemented by standalone hardware. At least two functions of one functional unit may be implemented by common hardware. Each functional unit may or may not be implemented by hardware. For example, the apparatus may include a processor and a memory storing a control program. Then the functions of a part of the functional units of the apparatus may be implemented by the processor reading the control program from the memory, and executing the program.

Examples 1 and 2 are merely examples, and a configuration implemented by appropriately modifying or changing the configurations of Examples 1 and 2, within the scope of the essence of the present invention, is included in the present invention. A configuration implemented by appropriately combining the configurations of Examples 1 and 2 is also included in the present invention.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment (s), and by a method performed by the computer of the system or apparatus by, for example, reading out and executing the computer executable instructions from the storage medium to perform the functions of one or more of the above-described embodiment (s) and/or controlling the one or more circuits to perform the functions of one or more of the above-described embodiment (s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-055573, filed on Mar. 22, 2017, which is hereby incorporated by reference herein in its entirety.

What is claimed is:

1. A display apparatus, comprising:

a light-emitting unit configured to emit light of a first color;

a converting unit configured to emit light of the first color, light of a second color, and light of a third color responding to irradiation of the light of the first color emitted from the light-emitting unit;

a detecting unit configured to output a first detected value in accordance with brightness of the light of the first color, and a second detected value in accordance with brightness of the light of the second color;

a correcting unit configured to correct a component corresponding to the first color, a component corresponding to the second color, and a component corresponding to the third color of input image data, based on the first detected value and the second detected value, and a display unit configured to display an image on a screen by transmitting the light emitted from the converting unit, based on the corrected input image data.

2. The display apparatus according to claim 1, wherein a band of a wavelength in which the detecting unit is capable of detecting brightness does not include a wavelength band of the light of the third color.

3. The display apparatus according to claim 1, further comprising:

a storing unit configured to store correspondence information related to a correspondence relationship of the first detected value, the second detected value and a correction parameter which the correcting unit uses to correct the input image data; and a determining unit configured to determine a correction parameter, based on the first detected value outputted from the detecting unit, the second detected value outputted from the detecting unit, and the correspondence information, wherein the correcting unit corrects the input image data by using the correction parameter determined by the determining unit.

4. The display apparatus according to claim 3, wherein the correspondence information includes first information that indicates a correspondence relationship of brightness of the light of the first color emitted from the light-emitting unit, and respective brightness of the light of the first color, the light of the second color, and the light of the third color, which are outputted from the converting unit responding to the irradiation of the light of the first color, and second information that indicates the relationship of brightness of the light of the second color, and the brightness of the light of the third color, which are outputted from the converting unit.

5. The display apparatus according to claim 4, wherein the first color is blue, the second color is green, the first information indicates correspondence relationship of: the first detected value, the second detected value, and XYZ tristimulus values of an emitted light including the light of the first color, the light of the second color, and the light of the third color emitted from the converting unit, in a case where a characteristic of the converting unit is a predetermined characteristic, and the second information indicates correspondence relationship of: a change ratio of an X value of the emitted light corresponding to a change of the characteristic of the converting unit from a predetermined characteristic, and a change ratio of a Y value of the emitted light corresponding to a change of the characteristic of the converting unit from a predetermined characteristic, and the determining unit acquires, from the first information, the XYZ tristimulus values and the second detected value corresponding to the first detected value outputted from the detecting unit, determines the Y value of the emitted light, for which the change of the characteristic of the converting unit is considered, based on the second detected value outputted from the detecting unit, the second detected value acquired from the first information, and the Y value of the XYZ tristimulus values acquired from the first information, determines the X value of the emitted light, for which the change of the characteristic of the converting unit is considered, based on the Y value of the XYZ tristimulus values acquired from the first information, the X value of the XYZ tristimulus values acquired from the first information, the determined Y value, and the second information, and determines, as the correction parameter, a parameter that includes a ratio of the determined X value and a predetermined X value, a ratio of the determined Y value and a predetermined Y value, and a ratio of the Z value of the XYZ tristimulus values acquired from the first information and a predetermined Z value.

6. The display apparatus according to claim 1, wherein the converting unit is a quantum dot sheet including a quantum dot converting the light of the first color into the light of the second color.

7. The display apparatus according to claim 1, wherein a dominant wavelength of the light of the first color is shorter than a dominant wavelength of the light of the second color.

8. The display apparatus according to claim 1, wherein the detecting unit includes a first sensor configured to output the first detected value and a second sensor configured to output the second detected value, the first sensor detects, at highest detection sensitivity, intensity of light having a dominant wavelength of the light of the first color or a neighboring wavelength thereof, and the second sensor detects, at highest detection sensitivity, intensity of the light having a dominant wavelength of the light of the second color or a neighboring wavelength thereof.

9. The display apparatus according to claim 1, wherein the detecting unit includes a first sensor configured to output the first detected value, and a second sensor configured to output the second detected value, a wavelength band, in which the first sensor has highest detection sensitivity, is included in a wavelength range of not less than 440 nm and less than 480 nm, and a wavelength band, in which the second sensor has highest detection sensitivity, is included in a wavelength range of not less than 480 nm and less than 580 nm, or a wavelength range of not less than 580 nm and not more than 700 nm.

10. The display apparatus according to claim 1, wherein the detecting unit includes a first sensor configured to output the first detected value, and a second sensor configured to output the second detected value, a wavelength band, in which the first sensor has highest detection sensitivity, is included in a wavelength range corresponding to a half width of intensity distribution of the light of the first color, and the wavelength band, in which the second sensor has the highest detection sensitivity, is included in a wavelength range corresponding to a half width of intensity distribution of the light of the second color.

11. The display apparatus according to claim 1, wherein the first color is blue, the second color is green, and the third color is red.

12. The display apparatus according to claim 1, wherein the light-emitting unit includes a plurality of light sources which correspond to a plurality of regions of the screen of the display unit, and are capable of controlling light emission independently.

13. A display apparatus comprising:

a plurality of light sources configured to emit light of a first color;

a converting sheet that is positioned further toward a front face side than the plurality of light sources, and is configured to convert a part of the light of the first color emitted from at least one light source of the plurality of light sources into light of a second color and light of a third color, which are different from the first color;

a first sensor that is positioned further toward a rear face side than the converting sheet, and is configured to output a first detected value corresponding to brightness of the light of the first color emitted from at least one light source of the plurality of light sources;

a second sensor that is positioned further toward the rear face side than the converting sheet, and is configured to output a second detected value corresponding to brightness of the light of the second color converted by the converting sheet;

a correcting unit configured to correct image data, based on the first detected value and the second detected value; and a display panel that is positioned further toward the front face side than the converting sheet, and is configured to display an image by transmitting the light of the first color, the light of the second color, and the light of the third color, based on the corrected image data, wherein the correcting unit corrects the image data by using a detected value of brightness of light, the number of color components of which is less than the number of color components of the image data.

14. The display apparatus according to claim 13, further comprising a sensor configured to detect the light of the third color, wherein the number of the first sensors and the number of the second sensors are greater than the number of the sensors configured to detect the light of the third color, respectively.

15. A control method of a display apparatus, comprising:

emitting, by a light-emitting unit, light of a first color;

converting, by a converting unit, emit light of the first color, light of a second color, and light of a third color responding to irradiation of the light of the first color emitted from the light-emitting unit;

outputting, by a detecting unit, a first detected value in accordance with brightness of the light of the first color, and a second detected value in accordance with brightness of the light of the second color;

correcting, by a correcting unit, a component corresponding to the first color, a component corresponding to the second color, and a component corresponding to the third color of input image data, based on the first detected value and the second detected value, and displaying, by a display unit, an image on a screen by transmitting the light emitted from the converting unit, based on the corrected input image data.

16. The control method according to claim 15, wherein a band of a wavelength in which the detecting unit is capable of detecting brightness does not include a wavelength band of the light of the third color.

17. A control method of a display apparatus comprising:

emitting, by at least one light source of a plurality of light sources, light of a first color;

converting, by a converting sheet that is positioned further toward a front face side than the plurality of light sources, a part of the light of the first color emitted from at least one light source of the plurality of light sources into light of a second color and light of a third color, which are different from the first color;

outputting, by a first sensor that is positioned further toward a rear face side than the converting sheet, a first detected value corresponding to brightness of the light of the first color emitted from at least one light source of the plurality of light sources;

outputting, by a second sensor that is positioned further toward the rear face side than the converting sheet, a second detected value corresponding to brightness of the light of the second color converted by the converting sheet;

correcting, by a correcting unit, image data based on the first detected value and the second detected value; and displaying, by a display panel that is positioned further toward the front face side than the converting sheet, an image by transmitting the light of the first color, the light of the second color, and the light of the third color, based on the corrected image data, wherein the correcting unit corrects the image data by using a detected value of brightness of light, the number of color components of which is less than the number of color components of the image data.

18. The control method according to claim 17, further comprising detecting, by a sensor, the light of the third color, wherein the number of the first sensors and the number of the second sensors are greater than the number of the sensors configured to detect the light of the third color, respectively.

19. A non-transitory computer readable medium that stores a program, wherein the program causes a computer to execute:

emitting, by a light-emitting unit, light of a first color;

converting, by a converting unit, emit light of the first color, light of a second color, and light of a third color responding to irradiation of the light of the first color emitted from the light-emitting unit;

outputting, by a detecting unit, a first detected value in accordance with brightness of the light of the first color, and a second detected value in accordance with brightness of the light of the second color;

correcting, by a correcting unit, a component corresponding to the first color, a component corresponding to the second color, and a component corresponding to the third color of input image data, based on the first detected value and the second detected value, and displaying, by a display unit, an image on a screen by transmitting the light emitted from the converting unit, based on the corrected input image data.

20. A non-transitory computer readable medium that stores a program, wherein the program causes a computer to execute:

emitting, by at least one light source of a plurality of light sources, light of a first color;

converting, by a converting sheet that is positioned further toward a front face side than the plurality of light sources, a part of the light of the first color emitted from at least one light source of the plurality of light sources into light of a second color and light of a third color, which are different from the first color;

outputting, by a first sensor that is positioned further toward a rear face side than the converting sheet, a first detected value corresponding to brightness of the light of the first color emitted from at least one light source of the plurality of light sources;

outputting, by a second sensor that is positioned further toward the rear face side than the converting sheet, a second detected value corresponding to brightness of the light of the second color converted by the converting sheet;

correcting, by a correcting unit, image data based on the first detected value and the second detected value; and displaying, by a display panel that is positioned further toward the front face side than the converting sheet, an image by transmitting the light of the first color, the light of the second color, and the light of the third color, based on the corrected image data, and the correcting unit corrects the image data by using a detected value of brightness of light, the number of color components of which is less than the number of color components of the image data.

* * * * *